US010054273B1

(12) United States Patent
Tan

(10) Patent No.: US 10,054,273 B1
(45) **Date of Patent: *Aug. 21, 2018**

(54) LIGHT DISTRIBUTION MECHANISM OF LED DOWNLIGHT

(71) Applicant: Treasure Best Ltd., Dongguan, Guangdong Province (CN)

(72) Inventor: Yiyi Tan, Dongguan (CN)

(73) Assignee: Treasure Best Ltd., Dongguan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/599,524

(22) Filed: May 19, 2017

(51) Int. Cl.

| | |
|---|---|
| ***F21S 8/02*** | (2006.01) |
| ***F21V 21/04*** | (2006.01) |
| ***F21V 14/04*** | (2006.01) |
| ***F21V 29/76*** | (2015.01) |
| ***F21V 29/502*** | (2015.01) |
| ***F21V 19/00*** | (2006.01) |
| *F21Y 115/10* | (2016.01) |

(52) U.S. Cl.
CPC ..... *F21S 8/02* (2013.01); *F21V 14/04* (2013.01); *F21V 19/003* (2013.01); *F21V 21/044* (2013.01); *F21V 29/502* (2015.01); *F21V 29/763* (2015.01); *F21Y 2115/10* (2016.08)

(58) Field of Classification Search
CPC ..... F21V 17/18; F21V 17/164; F21V 17/104; F21V 17/06; F21V 14/04; F21V 21/04–21/049; F21V 21/03; F21V 19/0035; F21V 19/0045; F21V 19/003; F21S 8/02
See application file for complete search history.

(56) References Cited

U.S. PATENT DOCUMENTS

| | | | | |
|---|---|---|---|---|
| 2,999,150 A * | 9/1961 | Kallel | B60Q 3/44 | 362/479 |
| 5,309,342 A * | 5/1994 | Heinen, Sr. | F21S 8/02 | 362/147 |
| 2013/0258677 A1* | 10/2013 | Fryzek | F21V 29/004 | 362/326 |
| 2014/0307450 A1* | 10/2014 | Cho | F21V 21/04 | 362/364 |

* cited by examiner

*Primary Examiner* — Mariceli Santiago
(74) *Attorney, Agent, or Firm* — Alan D. Kamrath; Kamrath IP Lawfirm, P.A.

(57) ABSTRACT

A light distribution mechanism includes a connecting element, a light distribution element and a fixed cylinder. The connecting element is engaged with a heat sink of an LED downlight. The light distribution element is accommodated in the fixed cylinder, and the fixed cylinder has least two buckles extended outwardly from the top edge and passing through the latch grooves formed on the top and inner surfaces of the connecting element to achieve a latching effect. Since the fixed cylinder and the connecting element can be latched and engaged easily, users may remove the fixed cylinder and the light distribution element by bare hands anytime to change the light distribution element to a different light distribution angle before its reinstallation, to facilitate changing the light distribution element and adjust the light distribution angle of the LED downlight.

4 Claims, 9 Drawing Sheets

LIGHT DISTRIBUTION MECHANISM OF LED DOWNLIGHT

BACKGROUND OF THE INVENTION

Field of the Invention

The present invention relates to a light distribution mechanism and, more particularly, to the light distribution mechanism having a light distribution element whose light distribution angle can be changed conveniently to adjust the light distribution angle of an LED downlight.

Description of the Related Art

In general, a conventional LED downlight has a light distribution mechanism installed in a light projection direction for projecting the light of an LED light source through a light distribution element installed in the light distribution mechanism to broaden the range of light. The conventional light distribution mechanism installed to the LED downlight has a base engaged or fixed to a heat sink or a cylinder of the LED downlight by screws. Then, a light distribution element is installed in the base, and a ring connecting element is provided for screwing and connecting the base to fix the light distribution element. The contact position between the base and the ring connecting element has inner and outer threads for the screw connection, so that the base and the ring connecting element can be engaged securely with each other by rotating and connecting the inner and outer threads with respect to each other. The ring connecting element is mainly provided for fixing the light distribution element into a position. When the LED light source passes through the base, the light source can pass the light distribution element accurately, and the range of the light projected by the LED light source can be scattered accurately. The light distribution element is mainly divided into a "lens" and a "reflective cup" which can be selectively changed as needed. In other words, either the lens or the reflective cup is a light distribution element. In the aforementioned light distribution mechanism, if it is necessary to adjust or change a light distribution element (regardless of the lens or the reflective cup), the ring connecting element is turned upside down and detached from the base. Then, the light distribution element installed in the base is removed before a new light distribution element is installed in the base, and the ring connecting element is reinstalled. However, the screwing operation between the ring connecting element and the base (regardless of clockwise or counterclockwise rotation) is very troublesome. Sometimes, the light distribution element in the base may accidentally fall out or be damaged when the ring connecting element is detached from the base, and such conventional structure definitely requires improvements.

In another conventional light distribution mechanism of an LED downlight, an engaging element (such as a screw) is used to fix and engage the light distribution element (regardless of the lens or the reflective cup) directly onto the heat sink or cylinder of the LED downlight. Thus, a tool (such as a screwdriver) is required to remove the engaging elements one by one before removing the original light distribution element, installing a new light distribution element, and screwing the screws in order to adjust or change any light distribution element. Similarly, the screwing operation is troublesome, and the light distribution element may fall out or be damaged easily. Such conventional structure also requires improvements.

SUMMARY OF THE INVENTION

To overcome the drawbacks of the conventional structure, a light distribution mechanism of an LED downlight is provided in accordance with the present invention.

Therefore, it is a primary objective of the present invention to provide a light distribution mechanism having a light distribution element whose light distribution angle can be changed conveniently to adjust the light distribution angle of an LED downlight.

Another objective of the present invention is to provide a light distribution mechanism having the features of easy adjustment, simple structure, secured connection, easy removal, manual operation, convenient application, low cost, and good utility.

To achieve the aforementioned objectives, the present invention provides a light distribution mechanism comprising a connecting element, a light distribution element and a fixed cylinder. The connecting element is engaged with the LED downlight and has a center hole formed at the center of the top surface of the connecting element. The inner surface of the top of the connecting element has at least two latch grooves disposed around the center hole. The light distribution element is a lens or a reflective cup. Both of the top and bottom of the fixed cylinder are hollow and have a containing space inwardly formed. The bottom periphery has a shield wall, and the top outer wall has at least two buckles extended upwardly. During assembling, the light distribution element is contained in the containing space of the fixed cylinder, the bottom periphery abuts the shield wall, and the fixed cylinder is passed through the buckle into the latch groove of the connecting element, so that the fixed cylinder and the connecting element are latched and engaged.

In the light distribution mechanism, the connecting element has a flat part, and a center hole formed at the center of the flat part, with the bottom surface having the latch groove, and with a small section extended outwardly and separately from both sides and then vertically downward to form a connecting plate. The connecting plate has a fixing hole and an adjusting hole. The connecting plates disposed on both sides of the connecting element and the LED downlight are pivotally coupled and engaged by passing an engaging element through the fixing hole, and then passing an adjusting screw through the adjusting hole and an arc slot formed on an adjusting plate of the LED downlight.

In the light distribution mechanism, the connecting element is a downwardly covered cylindrical object with the bottom inwardly hollow to form a containing space. The top surface has the center hole, and the bottom surface has the latch groove. The outer wall has more than two mounting holes formed thereon and provided for latching an elastic plate.

In the light distribution mechanism, the mounting holes formed on the outer wall of the connecting element have at least two hole positions of different heights provided for the elastic plate to be selectively latched to different heights.

Compared with the prior art, the present invention has the following advantageous effects:

1. The light distribution mechanism of the present invention can be latched and engaged with the connecting element by the fixed cylinder easily and conveniently. Users may manually remove the fixed cylinder and the light distribution element to replace a light distribution element with a different light distribution angle and then reinstall the components. Thus, the present invention has the effect of replacing a different light distribution element easily to adjust the light distribution angle of the LED downlight conveniently.

2. The light distribution mechanism of the present invention has the features of simple structure, secured connection, easy removal, manual operation, convenient application, low cost, and good utility.

DETAILED DESCRIPTION OF THE PREFERRED EMBODIMENTS

The technical characteristics, contents, advantages and effects of the present invention will be apparent with the detailed description of preferred embodiments accompanied with related drawings as follows.

The present invention discloses a light distribution mechanism applied in an LED downlight, and the general structure of the LED downlight is described below to understand the technical characteristics of the present invention.

Figure 1:
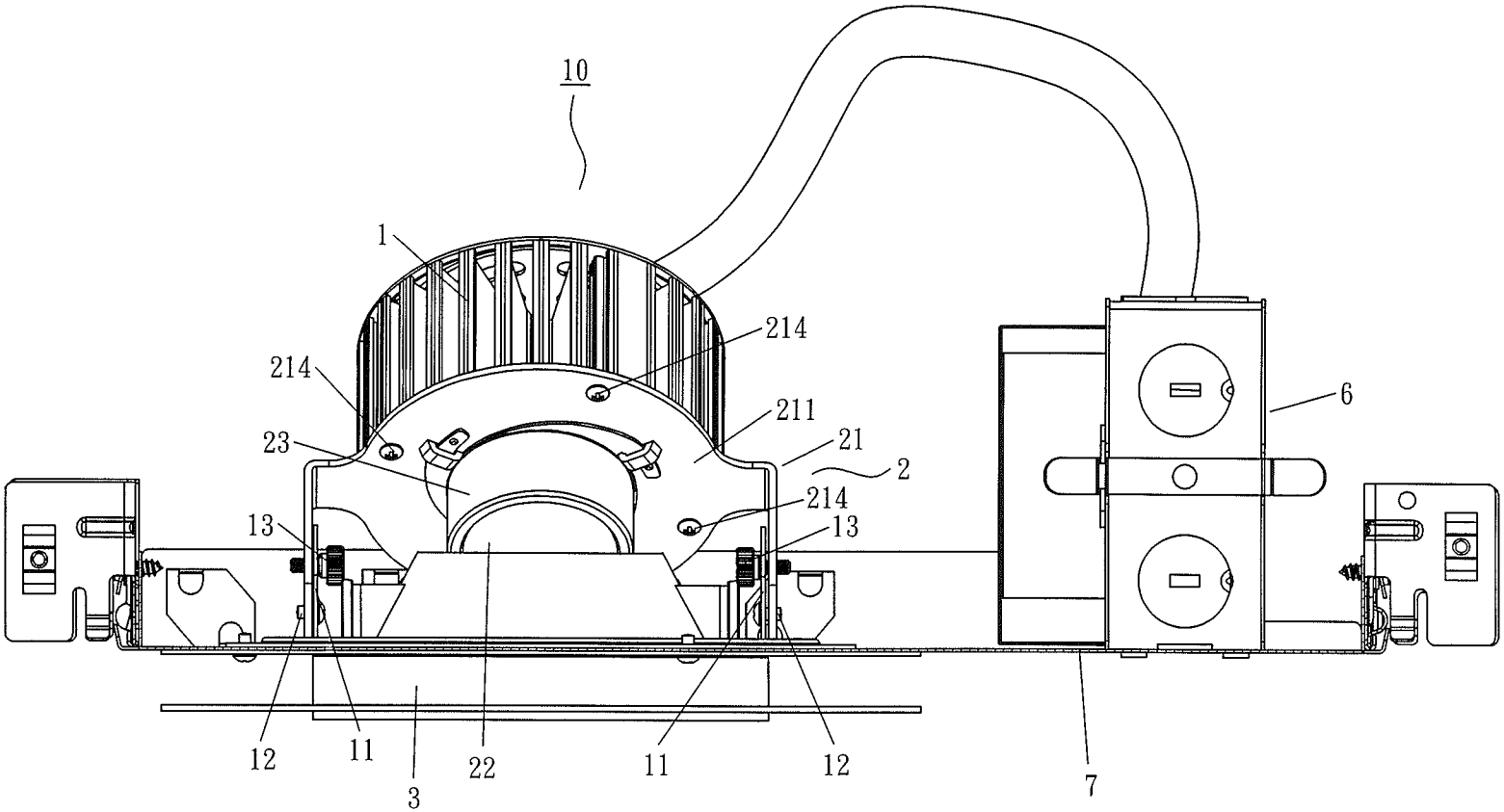
FIG. 1 is a schematic view of an LED downlight.
Figure 2:
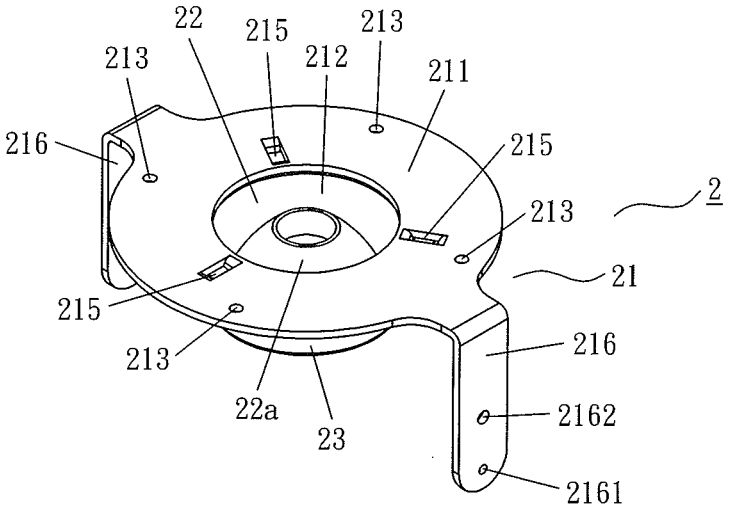
FIG. 2 is a perspective view of a light distribution mechanism having a lens with a selected angle of depression in accordance with a first preferred embodiment of the present invention.
Figure 3:
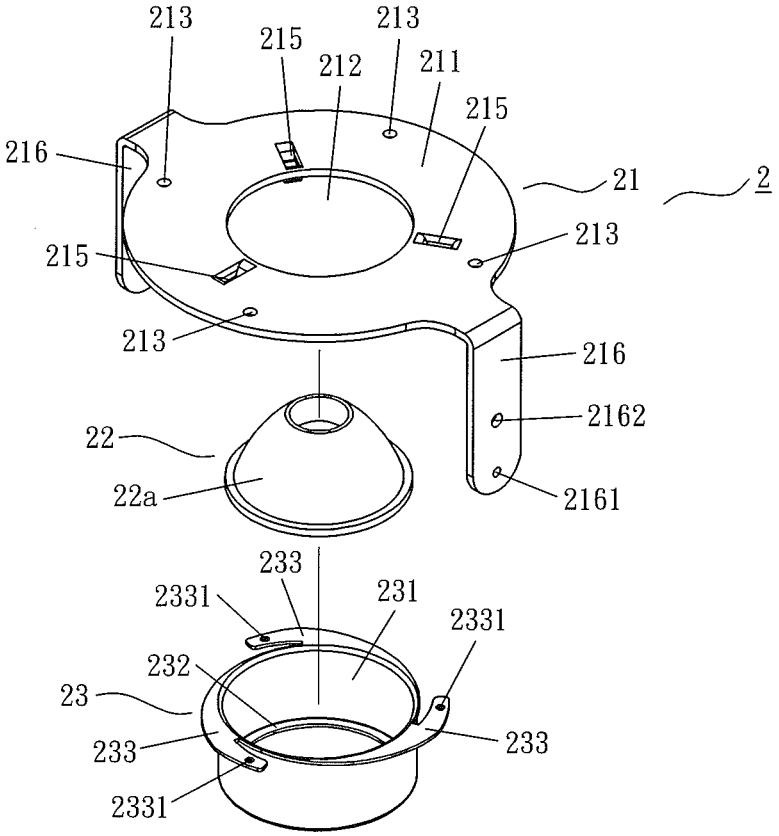
FIG. 3 is an exploded view of a light distribution mechanism having a lens with a selected angle of depression in accordance with the first preferred embodiment of the present invention.
Figure 4:
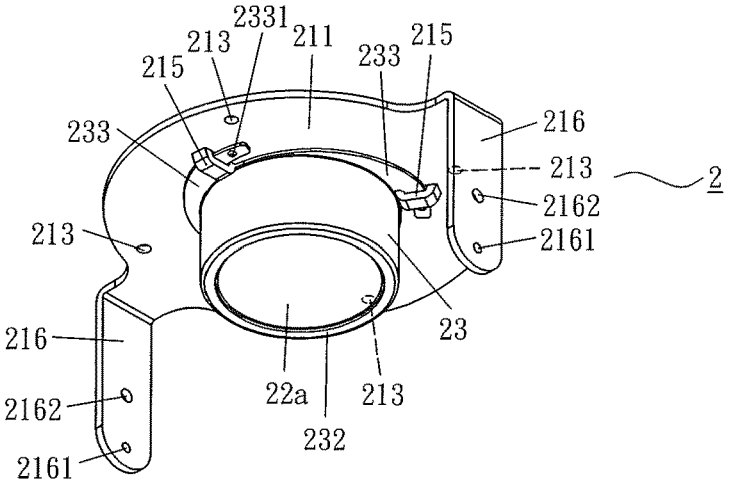
FIG. 4 is a perspective view of a light distribution mechanism having a lens with a selected angle of elevation in accordance with the first preferred embodiment of the present invention.
Figure 5:
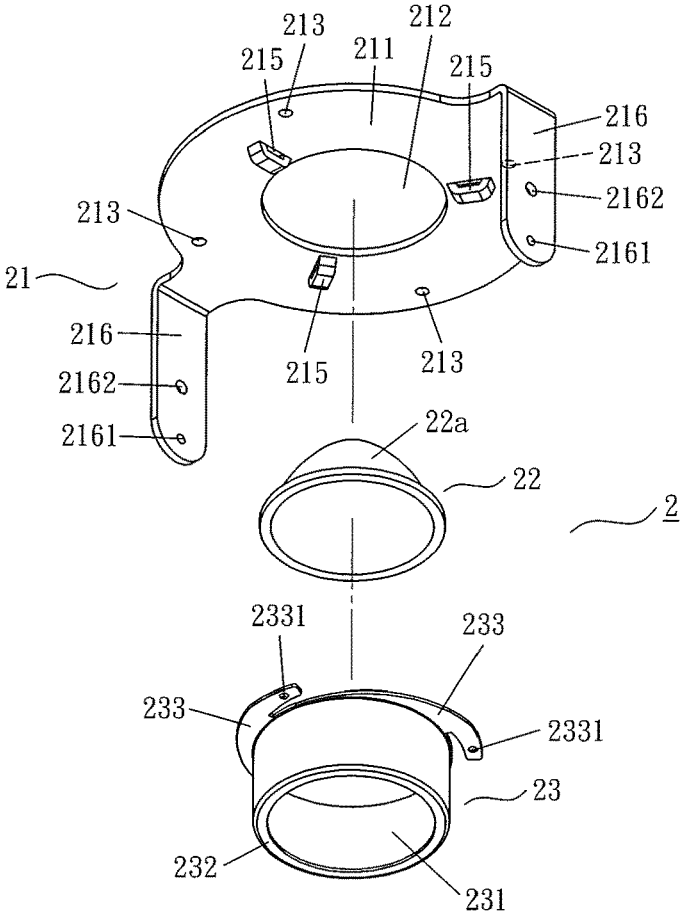
FIG. 5 is an exploded view of a light distribution mechanism having a lens with a selected angle of elevation in accordance with the first preferred embodiment of the present invention.

With reference to FIG. 1, an LED downlight 10 is one projecting the light emitted from an LED, and the LED downlight 10 comprises: a heat sink 1 having a light source device (not shown in the figure) installed at the center of the bottom and projecting the LED light downwardly from an LED light source; and a light distribution mechanism 2 installed at the bottom of the heat sink 1 and aligned precisely with the LED light source. When the light projected from the LED light source passes through the light distribution mechanism 2, the light distribution mechanism 2 can broaden the range of the light. In addition, a cover assembly 3 is installed at the bottom of the light distribution mechanism 2, such that after the light passing through the light distribution mechanism 2 further passes through the cover assembly 3, the range of light is broadened and softened further. The power of the LED downlight 10 is supplied by a power supply device 6, and the whole LED downlight 10 (including the power supply device 6) is installed on a bracket assembly 7 in order to install the LED downlight 10 at a high position of a building to project light downwardly.

With reference to FIGS. 2 to 9, a light distribution mechanism 2 in accordance with the first preferred embodiment of the present invention comprises a connecting element 21, a light distribution element 22 and a fixed cylinder 23. The connecting element 21 has a flat part 211, a center hole 212 formed at the center of the flat part 211, and a plurality of through holes 213 (preferably four through holes) formed around the external periphery and provided for passing through an engaging element 214 (such as a bolt) and locking with the heat sink 1 (as shown in FIG. 1) for engaging the flat part 211 with the bottom of the heat sink 1. The center hole 212 formed around the bottom surface of the flat part 211 has a plurality of latch grooves 215 (as least two latch grooves, and preferably three latch grooves). A small section is extended outwardly and separately from both sides of the flat part 211 and then is erected downwardly to form a connecting plate 216. The connecting plate 216 has a fixing hole 2161 and an adjusting hole 2162 formed thereon.

Figure 6:
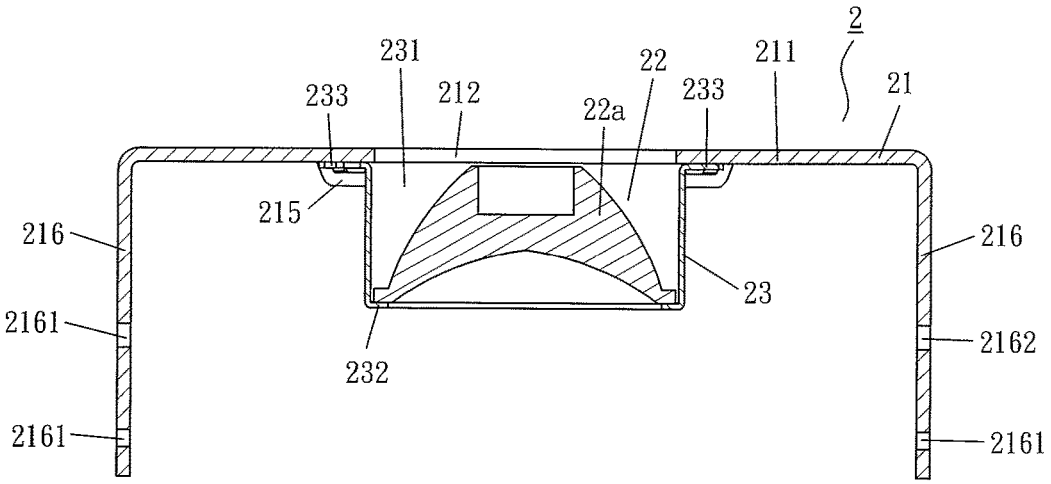
FIG. 6 is a cross-sectional view of a light distribution mechanism with a selected lens in accordance with the first preferred embodiment of the present invention.
Figure 7:
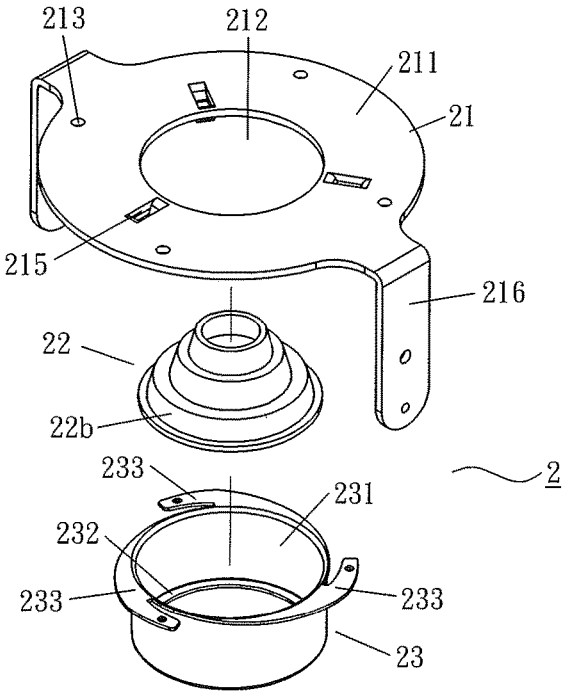
FIG. 7 is an exploded view of a light distribution mechanism having a reflective cup with a selected angle of depression in accordance with the first preferred embodiment of the present invention.
Figure 8:
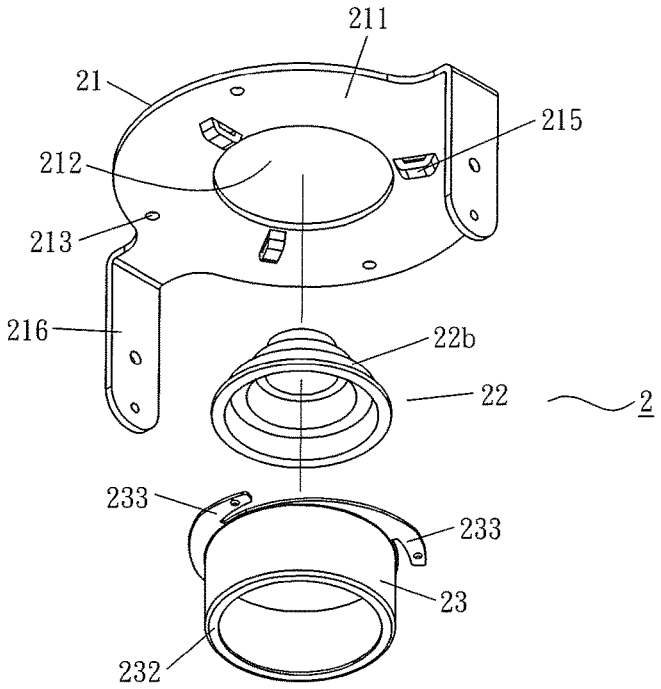
FIG. 8 is an exploded view of a light distribution mechanism having a reflective cup with a selected angle of elevation in accordance with the first preferred embodiment of the present invention.
Figure 9:
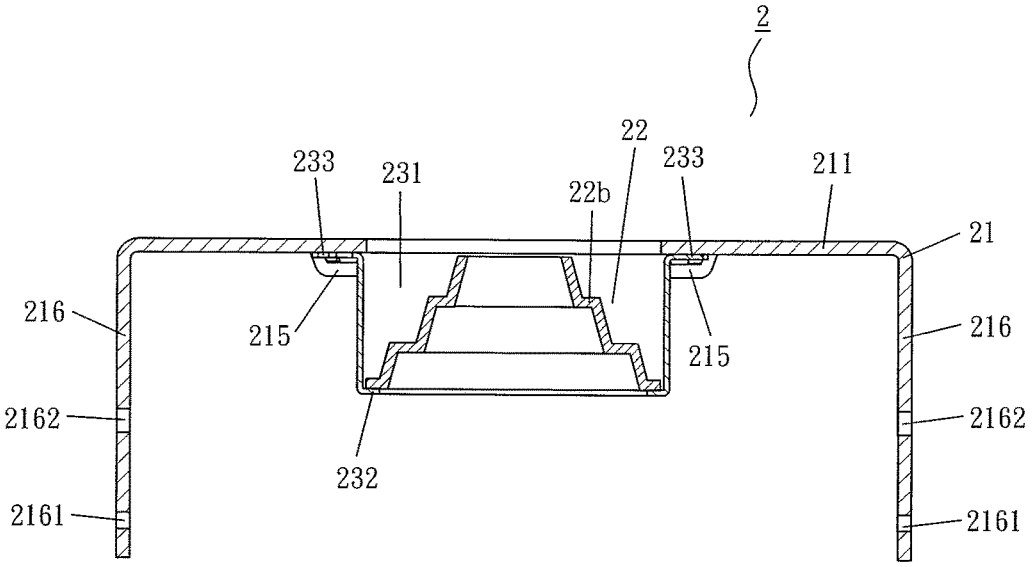
FIG. 9 is a cross-sectional view of a light distribution mechanism with a selected reflective cup in accordance with the first preferred embodiment of the present invention.

The light distribution element 22 may be either a lens **22*a* (as shown in FIGS. 2-6), or a reflective cup 22*b* (as shown in FIGS. 7-9). In other words, either the lens 22*a* or the reflective cup 22*b* is a light distribution element 22, and a user may selectively change a different light distribution element 22 (either the lens 22*a* or the reflective cup 22*b***) on their own to adjust the light diffusion angle of the light projection according to the requirements of the projected object or projection environment.

Both of the top and the bottom of the fixed cylinder 23 are inwardly hollow to form a containing space 231. A shield wall 232 is reserved at the periphery of the bottom of the fixed cylinder 23, and a plurality of buckles 233 is extended outwardly and upwardly with a small angle from the outer wall of the top of the fixed cylinder 23. The quantity of buckles 233 is corresponsive to the quantity of latch grooves 215 of the connecting element 21. Thus, the invention includes at least two, preferably three buckles 233, and the wall of each buckle 233 has a bump 2331 formed at a position from an outer end of a small section.

Before the light distribution mechanism 2 is installed, it is necessary to engage the connecting element 21 and the heat sink 1 with the two pre-installed mounting boards 11 of the LED downlight 10 as shown in FIG. 1. Thus, the flat part 211 of the connecting element 21 can be locked and coupled to the heat sink by an engaging element 214 (such as a bolt) after passing through the through hole 213 in order to engage the connecting element 21 to the bottom of the heat sink 1 securely. Then, the connecting plates 216 disposed on both sides of the connecting element 21 are arranged side by side with the mounting boards 11, and an engaging element 12 (such as a bolt or a rivet) is pivotally coupled and engaged after passing through a fixing hole 2161 of the connecting plate 216 and a fixing hole of the mounting board 11. An adjusting screw 13 is passed through an adjusting hole 2162 of the connecting plate 216 and an arc slot of an adjusting plate of the mounting board 11. Therefore, the adjusting screw 13 may be loosened to adjust the relative angle between the connecting plate 216 and the mounting board 11, and the adjusting screw 13 is tightened to fix the relative angle. Since the arc slot of the adjusting plate of the mounting board 11 has an angle limitation, the relative angle between the connecting plate 216 and the mounting board 11 can be adjusted within an angle range of 45 degrees to the left side or to the right side, to achieve the best utility of the light projection.

After the connecting element 21 is coupled between the heat sink 1 and the mounting board 11 of the LED downlight 10, the light distribution mechanism 2 can be installed for use. The light distribution element 22 (regardless of a lens 22*a* or a reflective cup 22*b*) is placed into the containing space 231 of the fixed cylinder 23, and the bottom periphery of the light distribution element 22 (regardless of the lens 22*a* or the reflective cup 22*b*) precisely abuts the shield wall 232 and is retained by the shield wall 232. Then, the buckles 233 of the fixed cylinder 23 are passed into the latch grooves 215 of the connecting element 21 one by one, and the fixed cylinder 23 is rotated. The bump 2331 passes across the latch groove 215 to prevent the buckle 233 of the fixed cylinder 23 from backing up by itself during a non-operating condition, and the fixed cylinder 23 is rotated further. Thus, the buckle 233 and the latch groove 215 are latched with each other closely, and the fixed cylinder 23 accommodates the light distribution element 22 (regardless of the lens 22*a* or the reflective cup 22*b*) to latch the bottom surface of the flat part 211 of the connecting element 21, to complete the installation of the light distribution mechanism 2 as shown in FIGS. 6 and 9.

Since there is a difference between the light distribution angles of the lens 22*a* and the reflective cup 22*b*, the lens 22*a* and the reflective cup 22*b* may be used selectively. If it is necessary to change the lens 22*a* or reflective cup 22*b*, the fixed cylinder 23 is rotated in a reverse direction, and the buckle 233 is loosened from the latch groove 215 gradually, until the bump 2331 is passively reversed and passed across the latch groove 215 for an exit. Thus, the fixed cylinder 23 can be detached from the connecting element 21, and the lens 22*a* or reflective cup 22*b* can be removed from the fixed cylinder 23 for replacement, change or maintenance. Then, the components are reinstalled according to the aforementioned installation procedure.

Figure 10:
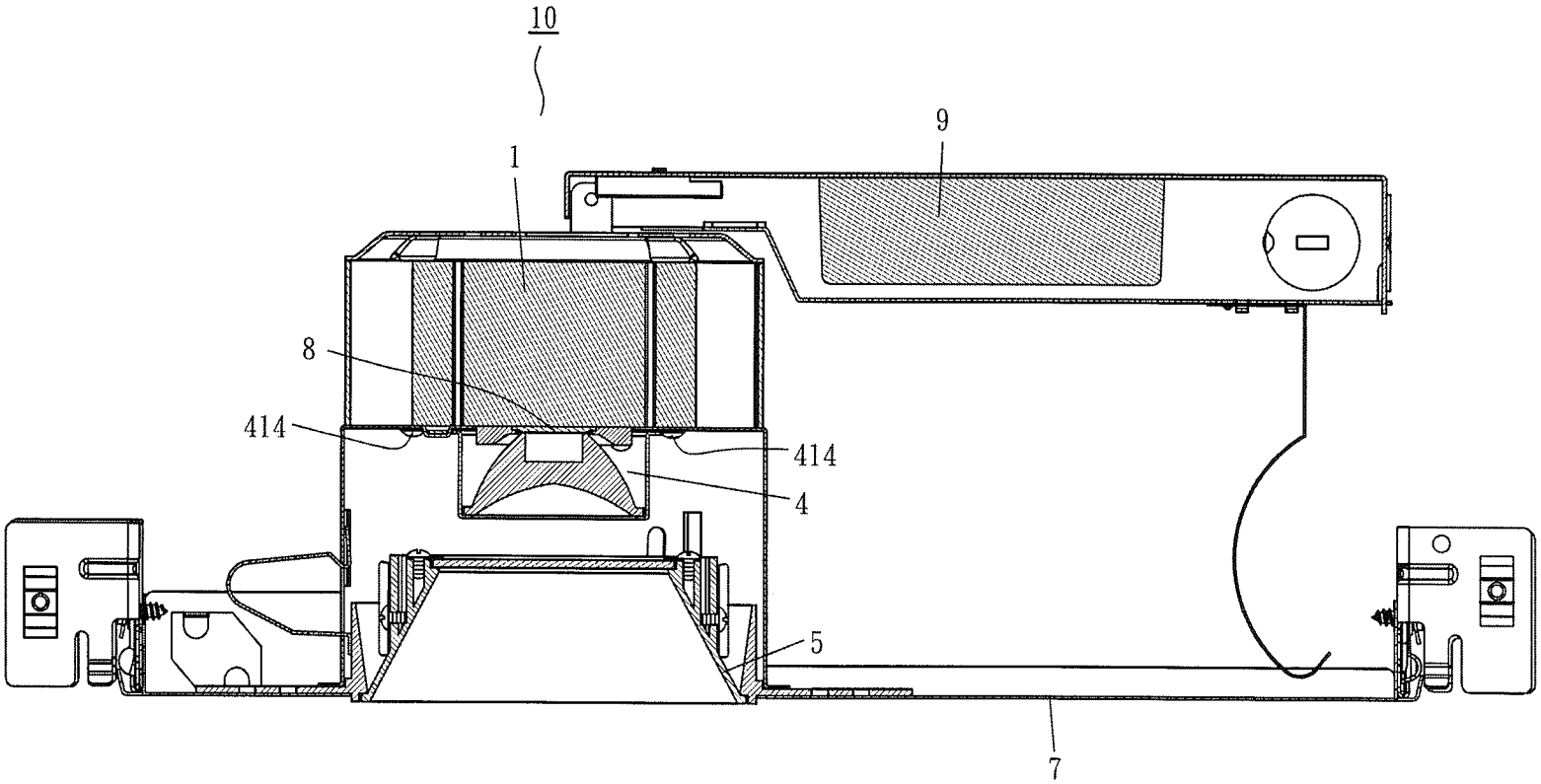
FIG. 10 is a schematic view of another LED downlight.

With reference to FIG. 10 for an LED downlight 10 for projecting an LED light, the LED downlight 10 comprises: a heat sink 1; a light source device 8 installed at the center of the bottom of the heat sink 1 and primarily provided for projecting the LED light from an LED light source downwardly; and a light distribution mechanism 4 installed to the bottom of the heat sink 1 and aligned precisely with the LED light source of the light source device 8. When the LED light source projects the LED light which passes through the light distribution mechanism 4, the light distribution mechanism 4 can expand the range of light. A cover assembly 5 is installed at the bottom of the light distribution mechanism 4 to expand the range of light and soften the light after passing through the light distribution mechanism 4 and then passing through the cover assembly 5 downwardly. The power of the LED downlight 10 is supplied by a power supply device 9, and the whole LED downlight 10 (including the power supply device 6) is mounted onto a bracket assembly 7 in order to install the LED downlight 10 at a higher position of a building to project light downwardly.

Figure 11:
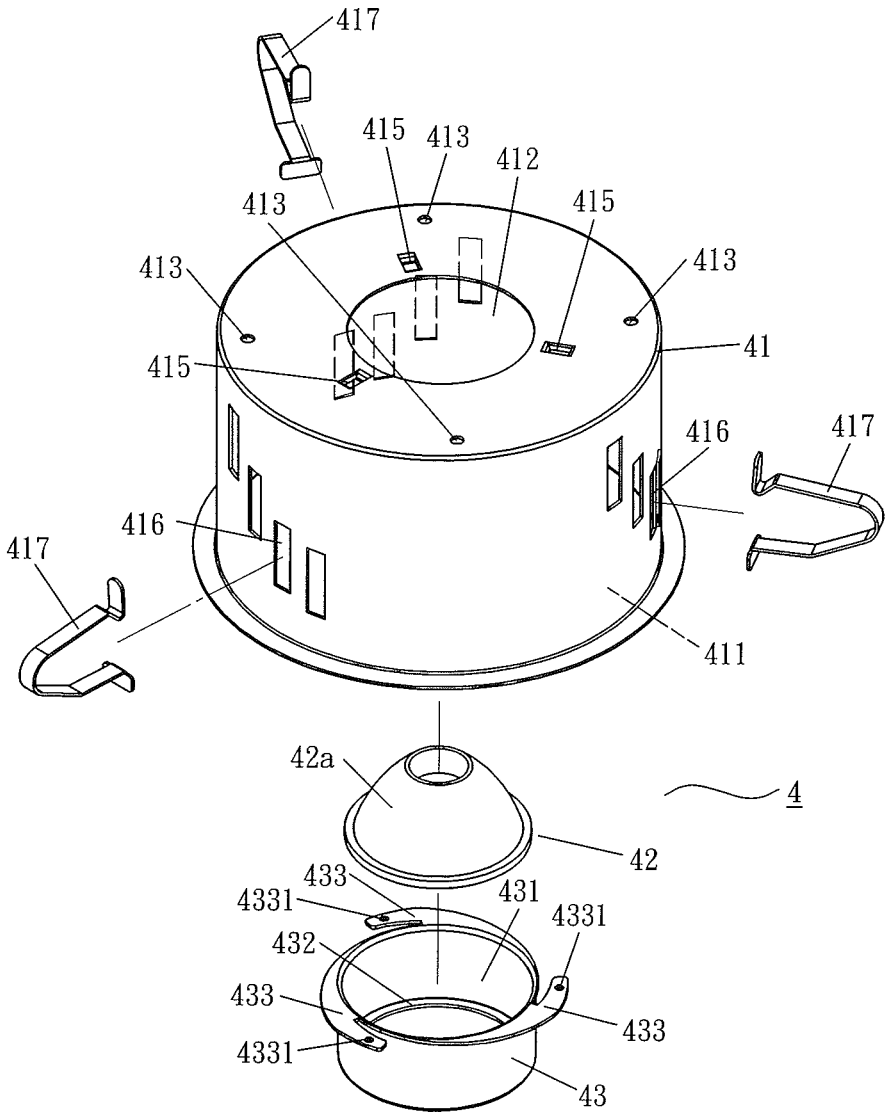
FIG. 11 is an exploded view of a light distribution mechanism having a lens with a selected angle of depression in accordance with a second preferred embodiment of the present invention.
Figure 12:
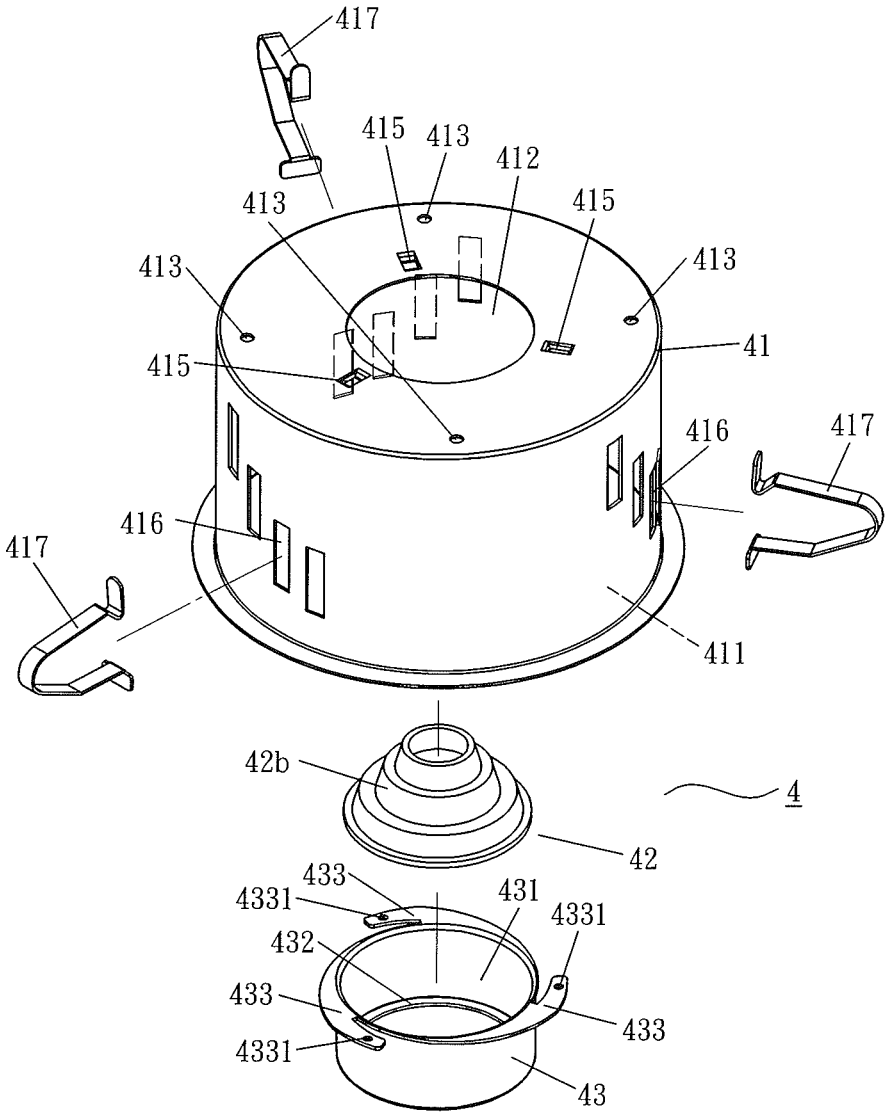
FIG. 12 is an exploded view of a light distribution mechanism having a reflective cup with a selected angle of depression in accordance with the second preferred embodiment of the present invention.

With reference to FIGS. 11~12 for a light distribution mechanism 4 in accordance with the second preferred embodiment of the present invention, the light distribution mechanism 4 comprises a connecting element 41, a light distribution element 42 and a fixed cylinder 43. The connecting element 41 is a downwardly covered cylindrical object with an inwardly hollow bottom to form a containing space 411. The connecting element 41 has a center hole 412 formed at the center of the top surface of the connecting element 41 and a plurality of through holes 413 formed around the external periphery of the connecting element 41 and provided for connection. It is preferable to have four through holes 413, but the invention is not limited to such arrangement. The through hole 413 is provided for an engaging element 414 (such as a bolt) to pass through and lock with the heat sink 1 (as shown in FIG. 10) in order to engage the connecting element 41 with the bottom of the heat sink 1, and the inner surface of the top of the connecting element 41 has a plurality of latch grooves 415 formed around the center hole 412. It is preferable to have at least two (such as three) latch grooves, but the invention is not limited to such arrangement. The outer wall of the connecting element 41 has a plurality of mounting holes 416 for latching the elastic plate 417. The mounting holes 416 are preferably arranged into three groups symmetrically with respect to the centre, but the invention is not limited to such arrangement. Each group of mounting holes 416 preferably has at least two hole positions of different heights provided for the elastic plate 417 to be selectively latched to a mounting hole 416 of a different height, but different groups of elastic plates 417 must be latched to the mounting hole 416 of the same height.

Figure 13:
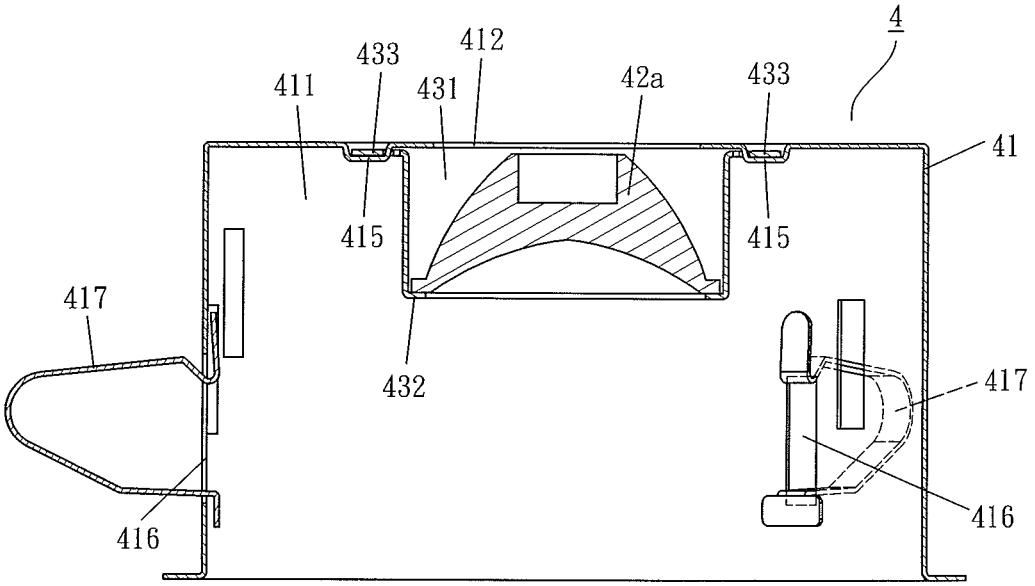
FIG. 13 is a cross-sectional view of a light distribution mechanism with a selected lens in accordance with the second preferred embodiment of the present invention.
Figure 14:
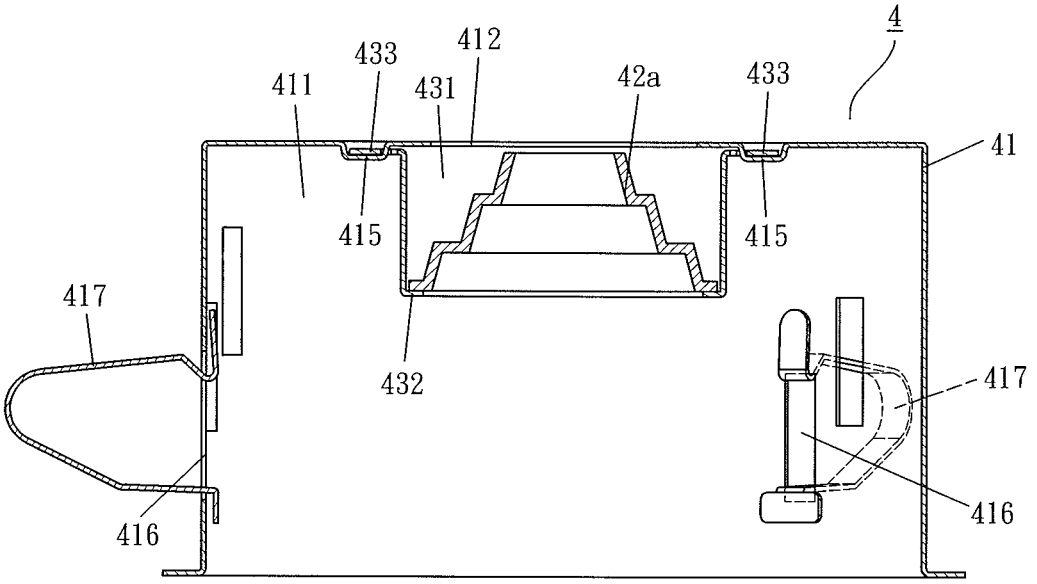
FIG. 14 is a cross-sectional view of a light distribution mechanism with a selected reflective cup in accordance with the second preferred embodiment of the present invention.

The light distribution element 42 of this preferred embodiment is the same as the light distribution element 22 of the first preferred embodiment. Similarly, a lens 42*a* (as shown in FIGS. 11 and 13) or a reflective cup 42*b* (as shown in FIGS. 12 and 14) may be selected. In other words, either the lens 42*a* or the reflective cup 42*b* is a light distribution element 42, and users may select a different light distribution element 42 (either the lens 42*a* or the reflective cup 42*b*) for adjusting the light diffusion angle of the light projection according to the requirements of the projected object or the projection environment.

The fixed cylinder 43 of this preferred embodiment is the same as the fixed cylinder 23 of the first preferred embodiment, and both of the top and the bottom are inwardly hollow to form a containing space 431. A shield wall 432 is reserved at the bottom periphery of the fixed cylinder 23, and the outer wall of the top of the fixed cylinder 43 has a plurality of buckles 433 extended outwardly and upwardly with a small angle. The quantity of buckles 433 is corresponsive to the quantity of latch grooves 415 of the connecting element 41. There are at least two buckles 433 and preferably three buckles 433, but the invention is not limited to this arrangement. Each buckle 433 has a bump 4331 formed on the wall of the buckle 433 and disposed at a small section at an outer end of the buckle 433.

Before the light distribution mechanism 4 is installed, it is necessary to connect the connecting element 41 with other components installed at the heat sink 1 and the LED downlight 10 as shown in FIG. 10. The top surface of the connecting element 41 is passed through the through hole 413 and then locked with the heat sink 1 by the engaging element 414 (such as a bolt) to engage the connecting element 41 with the bottom of the heat sink 1 securely. Then, the elastic plate 417 at the outer wall of the connecting element 41 abuts another component (such as the ceiling), to complete engaging the connecting element 41 with other components installed at the heat sink 1 and the LED downlight 10.

Therefore, the light distribution mechanism 4 can be installed for use, and the light distribution element 42 (either the lens 42*a* or the reflective cup 42*b*) is placed into the containing space 431 of the fixed cylinder 43. The bottom periphery of the light distribution element 42 (either the lens 42*a* or the reflective cup 42*b*) precisely abuts the shield wall 432 and is retained by the shield wall 432. Then, the buckles 433 of the fixed cylinder 43 are passed through the latch grooves 415 of the connecting element 41 one by one, and the fixed cylinder 43 is rotated, so that the bump 4331 passes across the latch groove 415 to prevent the buckle 433 of the fixed cylinder 43 from backing up by itself during a non-operating condition. When, the fixed cylinder 43 is rotated further, the buckle 433 and the latch groove 415 are latched with each other more closely. The fixed cylinder 43 accommodates the light distribution element 42 (regardless of the lens 42*a* or the reflective cup 42*b*) to latch the containing space 411 of the connecting element 41, to complete the installation of the light distribution mechanism 4 as shown in FIGS. 13 and 14.

Since the lens 42*a* and the reflective cup 42*b* may have different light distribution angles, they may be used selectively. If it is necessary to replace the lens 42*a* or the reflective cup 42*b*, the fixed cylinder 43 is rotated in a reverse direction, so that the buckle 433 is loosened from the latch groove 415 gradually. Until the bump 4331 is passively reversed and passed across the latch groove 415 for an exit, the fixed cylinder 43 can be detached from the connecting element 41, and the lens 42*a* or the reflective cup 42*b* can be removed from the fixed cylinder 43 for replacement, change or maintenance. Then, the components are reinstalled according to the aforementioned installation procedure.

In summation of the description above, the present invention discloses a light distribution mechanism installed to an LED downlight, and the light distribution mechanism comprises a connecting element, a light distribution element and a fixed cylinder. The connecting element is engaged with a heat sink of the LED downlight, and the light distribution element is placed into the fixed cylinder. Then, at least two buckles are extended outwardly from the top edge of the fixed cylinder and passed through the latch grooves formed on the inner surface of the top of the connecting element to achieve the latching effect. Since the fixed cylinder can be latched and engaged with the connecting element conveniently, users may manually remove the fixed cylinder and the light distribution element to replace a light distribution element with a different light distribution angle and then reinstall the components. Therefore, the present invention can achieve the effect of changing a light distribution element easily, and the LED downlight with the light distribution angle has the features of easy adjustment, simple structure, secured connection, easy removal, manual operation, convenient application, low cost, and good utility.

In summation of the description above, the present invention is novel and capable of achieving expected objects and effects. While the invention has been described by way of specific embodiments, numerous modifications and variations could be made thereto by those skilled in the art without departing from the scope and spirit of the invention set forth in the claims.

What is claimed is:

1. A light distribution mechanism of an LED downlight, comprising a connecting element, a light distribution element, and a fixed cylinder, wherein the connecting element is engaged with the LED downlight and has a center hole formed at a center of a top surface of the connecting element, wherein an inner surface of a top of the connecting element has at least two latch grooves disposed around the center hole; wherein the light distribution element is a lens or a reflective cup; wherein both of a top and a bottom of the fixed cylinder are hollow and have a containing space inwardly formed, wherein a bottom periphery of the fixed cylinder has a shield wall, wherein a top outer wall of the fixed cylinder has at least two buckles extended upwardly; wherein the light distribution element is contained in the containing space of the fixed cylinder when assembled, wherein the bottom periphery abuts the shield wall, wherein the fixed cylinder is passed through the at least two buckles into the at least two latch grooves of the connecting element, and wherein the fixed cylinder and the connecting element are latched and engaged.

2. The light distribution mechanism of an LED downlight according to claim 1, wherein the connecting element has a flat part, a center hole formed at a center of the flat part, a bottom surface having the at least two latch grooves, and a small section extended outwardly and separately from both sides and then vertically downward to form connecting plates, wherein each connecting plate has a fixing hole and an adjusting hole; wherein the connecting plates disposed on both sides of the connecting element and the LED downlight are pivotally coupled and engaged by passing an engaging element through the fixing hole, and wherein an adjusting screw is passed through the adjusting hole and an arc slot formed on an adjusting plate of the LED downlight.

3. The light distribution mechanism of an LED downlight according to claim 1, wherein the connecting element is a downwardly covered cylindrical object with a bottom inwardly hollow to form the containing space and the top surface has the center hole, wherein a bottom surface of the connecting element has the at least two latch grooves, and wherein an outer wall has more than two mounting holes formed thereon and provided for latching an elastic plate.

4. The light distribution mechanism of an LED downlight according to claim 3, wherein the more than two mounting holes formed on the outer wall of the connecting element have at least two hole positions of different heights provided for the elastic plate to be selectively latched to different heights.

* * * * *